US008727391B2

(12) United States Patent
Berginc

(10) Patent No.: US 8,727,391 B2
(45) Date of Patent: May 20, 2014

(54) SAFETY LOCK FOR A DOOR OF A HOUSEHOLD APPLIANCE, PREFERABLY OF A WASHING MACHINE

(75) Inventor: Bostjan Berginc, Srpenica (SI)

(73) Assignee: ITW METAFLEX, d.o.o. Tolmin, Tolmin (SI)

( * ) Notice: Subject to any disclaimer, the term of this patent is extended or adjusted under 35 U.S.C. 154(b) by 521 days.

(21) Appl. No.: 13/057,182

(22) PCT Filed: Sep. 2, 2009

(86) PCT No.: PCT/IB2009/053829

§ 371 (c)(1),
(2), (4) Date: Feb. 2, 2011

(87) PCT Pub. No.: WO2010/026536

PCT Pub. Date: Mar. 11, 2010

(65) Prior Publication Data

US 2011/0133490 A1 Jun. 9, 2011

(30) Foreign Application Priority Data

Sep. 3, 2008 (SI) ..... P-200800206

(51) Int. Cl.
*E05C 1/06* (2006.01)

(52) U.S. Cl.
USPC ..... 292/144; 292/DIG. 69; 70/275; 337/77

(58) Field of Classification Search
USPC ..... 292/144, DIG. 69; 70/275; 337/77, 68
See application file for complete search history.

(56) References Cited

U.S. PATENT DOCUMENTS

| | | | | | |
|---|---|---|---|---|---|
| 3,549,838 | A * | 12/1970 | Waskowsky | ..... | 200/83 WM |
| 3,892,933 | A * | 7/1975 | Rocchitelli | ..... | 337/77 |
| 4,032,180 | A * | 6/1977 | Pohl | ..... | 292/341.16 |
| 4,620,735 | A * | 11/1986 | Heydner | ..... | 292/144 |
| 6,634,684 | B2 * | 10/2003 | Spiessl | ..... | 292/341.16 |
| 7,775,070 | B2 * | 8/2010 | Lim et al. | ..... | 68/12.26 |

FOREIGN PATENT DOCUMENTS

| | | | |
|---|---|---|---|
| EP | 1621658 | A2 | 2/2006 |
| EP | 1645706 | A2 | 4/2006 |
| GB | 2128283 | A | 4/1984 |
| SI | 21888 | A | 4/2006 |
| WO | 2005/106099 | A1 | 11/2005 |

OTHER PUBLICATIONS

ISR and Written Opinion for PCT/IB2009/053829.

* cited by examiner

*Primary Examiner* — Thomas Beach
*Assistant Examiner* — Mark Williams
(74) *Attorney, Agent, or Firm* — Lowe Hauptman & Ham LLP

(57) ABSTRACT

A safety lock for a door of a household appliance, preferably of a washing machine, includes a housing on one end of which there is a mechanical assembly of the door lock, on the other end there is an assembly of the electric switch used to reach closed or interrupted electric circuit, into which also a part of a programme selection switch is included, whereby the assembly of the door lock and the assembly of the electric switch are mutually linked by a slider, which is designed in a way that its lug engages with the hook of the appliance door, when the hook is in the guide, so that upon manual closing of the appliance door the hook pushes the slider towards the assembly when entering the guide.

20 Claims, 3 Drawing Sheets

SAFETY LOCK FOR A DOOR OF A HOUSEHOLD APPLIANCE, PREFERABLY OF A WASHING MACHINE

RELATED APPLICATIONS

Figure 1:
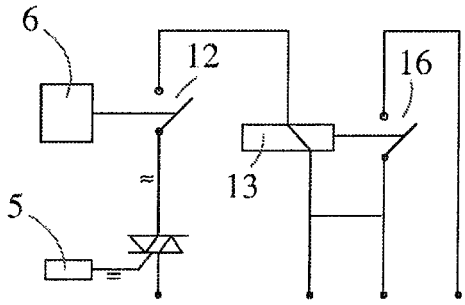

The present application is National Phase of International Application Number PCT/IB2009/053829 filed Sep. 2, 2009, and claims priority from, Slovenia Application Number P-200800206 filed Sep. 3, 2008.

SUBJECT OF INVENTION

The subject of the present invention is a safety lock for a door of a household appliance, preferably a washing machine.

TECHNICAL PROBLEM

The technical problem solved by the present invention is how to conceive such safety lock for a door of a household appliance that will include securing of the mechanical lock against opening of the door whenever the appliance is switched on (performs the washing operation), whereas securing of the safety lock must be switched off immediately after the work process of the appliance is completed, e.g. immediately after the completion of washing under the consideration of the fact that the dimension of the safety lock depends on the construction of the appliance, to which the lock must be subjected. A possible defect on electric or electronic elements of the lock should not cause any change in the current function of the safety lock as a whole. Since a safety lock of this type is intended for large series production of household appliances, its price must be acceptable for the market as dictated by the financial structure of a household appliance.

PRIOR ART

The patent SI-21888 (ITW Metalflex, d.o.o.) discloses a safety lock of this type, whose characteristic lies in that a mechanical assembly of a door lock prevents the opening of the appliance by means of an electrically powered bimetal switch, whereas power is present only when the appliance is switched on. Only after the work process is completed and the programme selection switch automatically switches the appliance off, the bimetal is no longer powered thus allowing for the mechanical assembly to release the door lock and the user can open the door by pushing the adequate button. Since the bimetal operates slowly, a waiting time is foreseen after the appliance completed the operation, in order for the bimetal to cool off and deflect to release the door opening lock.

There is a need for such safety lock for a door of a household appliance with immediate function that will allow the user to open the door immediately after the work process of the appliance has been completed.

Solution to the Technical Problem

The described technical problem is solved by a safety lock of the invention, the essential characteristic of which is based on the same electric connection diagram as used in the cited patent SI-21888, in which the bimetal controlled switch is replaced by a switch controlled by a DC electromagnet, the core of which engages with permanent magnets. DC for the electromagnet is generated in a known electronic way from the mains AC; an accumulator or a battery can also be used as a power source. The programme selection switch determines the DC direction and thus polarisation of the electromagnet core. Permanent polarisation of both permanent magnets determines final positions of the electromagnet core, i.e. adjacent to one or another permanent magnet and thus closing or opening of the switch leading load and/or signal current to the programme selection switch. Should the load and/or signal current be interrupted for any reason, most probably due to a defect, the current function of the safety lock is preserved. The lock, which is also the carrier of a sliding contact of the switch for load and/or signal current engages with a slider moved by the hook; it allows the slider to move and the door to open only when the switch of the load and/or signal current is open, i.e. the programme selection switch determines the adequate polarisation of the electromagnet, which removes the core and the switch away from the slider.

The second embodiment extends the above technical solution by such polarisation of permanent magnets that fields of both said permanent magnets of various poles are adjacent (north-south and vice versa), and at the same time the coil of the electromagnet remains in axial direction of the core outside the core centre. The safety lock of the invention thus functions somewhat differently. As far as application is concerned, closing of the door and switching-on of the appliance is followed by manual closing, then door locking and only then closing of the electric contact, which gives the programme selection switch a signal that the door is closed and locked. It might namely happen in large series production and in order to preserve the needed clearance between individual elements that said electric contact would close prior to door locking. A user might open the door within this short time interval.

Figure 2:
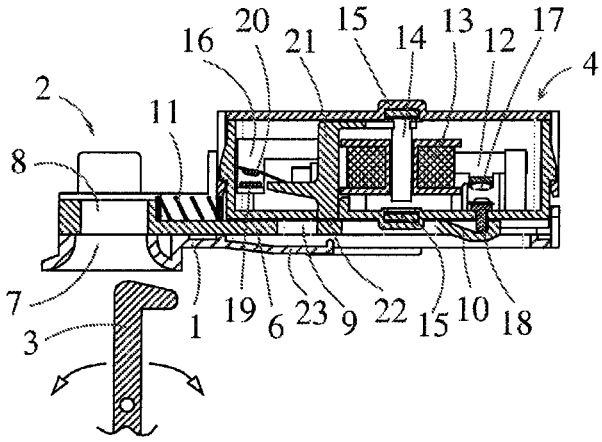
Figure 3:
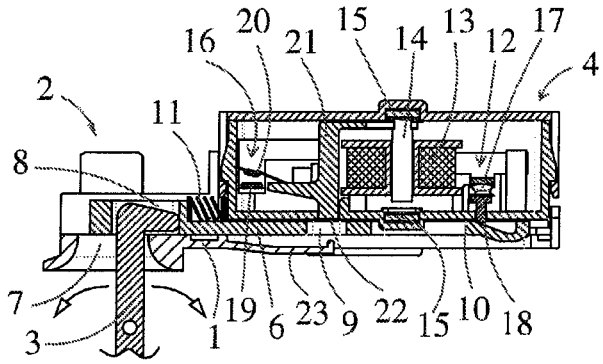
Figure 4:
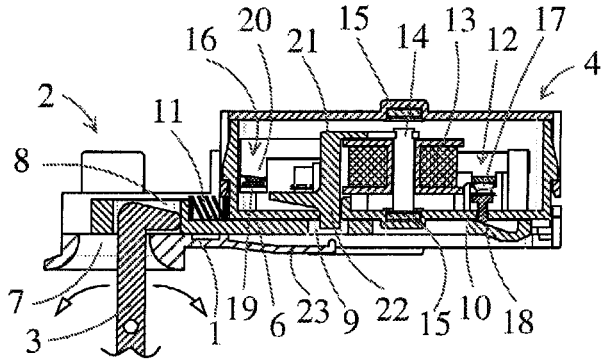

The essence of the invention will now be described in more detail by a description of an embodiment accompanied by the enclosed drawing, in which FIG. 1 shows an electric circuit diagram within the safety lock of the invention, FIG. 2 shows a longitudinal cross-section of the lock of the invention with the appliance door opened, FIG. 3 shows the same in the situation when the appliance door is closing, FIG. 4 shows the same in the situation when the door is closed and the appliance is operating.

Figure 5:
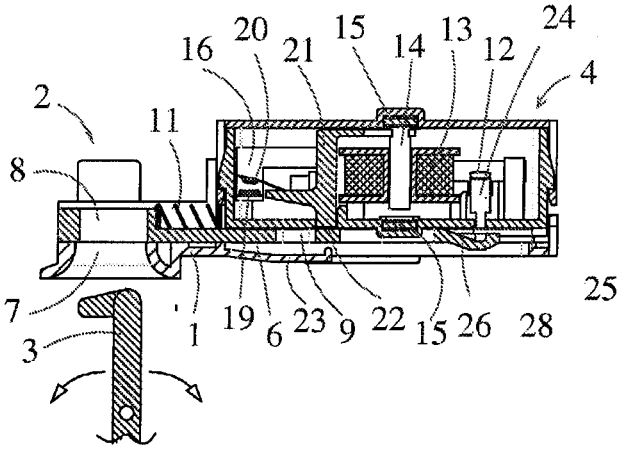
Figure 6:
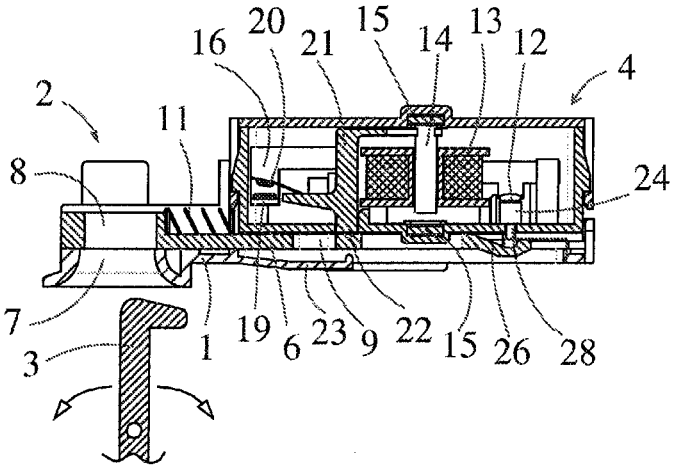
Figure 7:
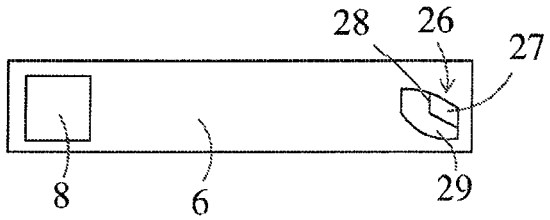

FIG. 5 shows a longitudinal cross-section of the safety lock of the second embodiment with the appliance door open, FIG. 6 shows the same with the appliance door closed, FIG. 7 shows the top view of the slider.

FIRST EMBODIMENT

The safety lock for a door of a household appliance, preferably of a washing machine, is composed of a housing 1 on one end of which there is a mechanical assembly 2 of the door lock, of which only a hook 3 is shown. On the other end there is an assembly 4 of the electric switch used to reach closed or interrupted electric circuit, into which also a part of a programme selection switch 5 is included (which is not subject of the present invention), whereby the assembly 2 of the door lock and the assembly 4 of the electric switch are mutually linked by a slider 6.

The assembly 2 of the door lock is designed in a way that a guide 7, preferably an opening intended to receive a hook 3 in the situation of closed door is provided on the base panel 1. The slider 6 is designed in a way that its lug 8 engages with the hook 3 when the latter is in the guide 7, so that upon manual closing of the appliance door the hook 3 pushes the slider 6 towards the assembly 4 when entering the guide 7. On a part of the slider 6 in the area of the assembly 4 there is an opening 9 and an inclination 10. The function of the latter two will be described in the continuation . A spring 11 is foreseen to return the slider 6 to its original position while the appliance door is opening.

The assembly 4 of the electric switch is composed of a switch 12, of an electromagnetic coil 13 with an axially movable core 14, of two permanent magnets 15 located at a distance from the ends of the core 14 and of a switch 16 included in the circuit for the indication of openness/closeness of the door together with the programme selection switch 5, which is no longer part of the invention.

The switch 12 is made of a fixed contact 17 and a movable contact 18 engaging with said inclination 10 on the slider 6. In the situation of the appliance door open and the slider 6 moved to one of the end positions provided by the spring 11, the inclination 9 renders it possible to move the movable contact 18 away from the fixed contact 17 and thus the openness of the switch 12, whereas in the situation with the door closed, the hook 3 holds the slider 6 in another end position and simultaneously holds the inclination 10 in a way that the latter brings the movable contact 18 closer to the fixed contact 17 herewith ensuring the switch 12 to close.

The switch 16 included in the circuit for the indication of door openness/closeness consists of a fixed contact 19 positioned in the housing 1 of the assembly 4 and of a movable contact 20 positioned on a support 21 that is fixed on the core 14 of the coil 13. By axially moving the core 14 as described above, the switch 16 is closed or opened and the current in the circuit for the indication of door openness/closeness thus established or interrupted.

The switch 16 is subject to a double-point control by the coil 13 with DC, the polarisation of which is determined by the programme selection switch 5 depending on the operation of the appliance or termination of operation. The current flowing through the switch 16 supply either (a) directly at least one essential user of a household appliance or (b) same, yet via a power switch.

The core 14 is axially movable by means of the coil 13 by a distance defined by the gap to the each adjacent permanent magnet 15. The magnets 15 are positioned with adjacent equal poles, e.g. north poles of both magnets 15 face each other, whereas there is the core 14 in between. By changing polarity of DC in the coil 13 by means of the programme selection switch 5, the polarity of the coil 14 changes, with which electromagnetic attraction force to one or another permanent magnet 15 is determined The significance of the core 14 movement will be described at a later stage.

When the circuit for the indication of door openness/closeness in the switch 16 is closed, which occurs by the movement of the holder 21 positioned on the core 14, the part 22 of the holder 21 sinks into the opening 9 in the slider 6 thus preventing it from moving in direction towards the assembly 2, whereby the hook 3 cannot be turned upon a manual opening of the door.

On the housing 1 there is a means 23 used to manually switch the switch 16 off in case the safety lock or electric installation gets damaged or in case of the mains breakdown. The holder 21 is moved to another end position, in which it is then held by the opposite permanent magnet 15. Said means is foreseen by the construction of the appliance and is not subject of the present invention. The safety lock of the invention herewith meets one of the standard conditions for the appliances of this type.

The safety lock of the invention functions as follows: in the situation of the open door of the appliance both switches 12 and 16 are opened and also the circuit for the supply of the coil 13 and the circuit for the indication of door openness/closeness are interrupted. The slider 6 is in a position, in which its lug 8 engages with the guide 7 and allows the hook 3 to enter upon manual closing of the door. When the hook 3 enters the guide 7, the hook 3 shifts the slider 6 towards the assembly 4. The inclination 10 on the slider 6 pushes the movable contact 18 towards the fixed contact 17 , thus closing the switch 12 and the circuit for the supply of the coil 13. As a function of the appliance the programme selection switch 5 thus forms polarised DC to the coil 13 so that the latter polarises the core 14 in a way to come closer to one of the permanent magnets 15 thus shifting the lock 21 and herewith the movable contact 20 as well, so that the switch 16 is closed and so is the circuit for the indication of openness/closeness of the appliance door. As the signal of indication of closeness/openness of the door reaches the programme selection switch 5, further steps of the work process can be implemented within same. Since one part 22 of the holder 21 is positioned in the opening 9 in the slider 6 in this mode of the circuit for the indication of openness/closeness of the appliance door, the slider 6 is mechanically blocked if shifted towards the assembly 2. As a consequence, the door of the appliance cannot be manually opened in this situation.

As the programme selection switch 5 terminates the working process of the appliance, it changes polarisation within the coil 13, the core 14 shifts to another permanent magnet 15 thus opening the switch 16 and simultaneously the part 22 exits the opening 8 in the slider 6. The slider 6 is unblocked and can be shifted towards the assembly 2 upon manual opening of the door. With the lock of the invention this procedure is implemented instantly, whereas other locks of this type require a certain time period for the bimetal to cool off and to deflect by a distance to release the mechanical lock for manual door opening.

Since fixing of the core 14 and through it the fixing of the holder 22 of the movable contact 20 of the switch 16 is provided by permanent magnets 15, a potential breakdown of electrical elements or mains supply breakdown cannot cause damage or even failure of appliance safety, as ensured by the safety lock of the invention.

Second Embodiment

In order to provide for the additional function the second embodiment has said coil 13 shifted axially along the core 14 towards said permanent magnet 15. The structure of said switch 12 is rearranged as well. Said switch 12 consists of several parts. The movable contact 18 is designed as a spring moved by an axially movable plug 24 positioned on the same location as said movable contact 18 in the first embodiment. As said contact 18 directly abuts said slide 6 said plug 24 abuts said element 25, one end of which is pivotably and at the same time axially movably arranged within said housing 1, and the other end fits an indentation 26 in said slider, wherein said indentation 26 is designed as a two-part component, one part 27 has a step 28 and the other part 29 is designed as an inclination as already known in the first embodiment (reference number 10). Permanent magnets 15 are mutually oriented in a way that the poles north-south or vice versa match.

A further change with respect to the first embodiment lies in that a capacitor (not shown in figures) is foreseen as a source of power supply to said coil 13, said capacitor supplying current upon the closure of said switch 12 to said coil 13 only for a very short time of a few nanoseconds. After this very short time is over, said core 14 returns to non-polarised situation. The current of the capacitor is polarised in a way to create such polarisation within said coil 13 and core 14 that said core 14 is attracted to said permanent magnet 15, which is remote from said slider 6, and is reflected from said magnet 15, which is close to said slider 6.

The assembly of the second embodiment functions as follows: in the situation of door closing said hood 3 starts shifting said slider 6 as in the first embodiment. Only when said slider 6 reaches such position that allows said plug 24 to move on said step 28 instantaneously for the height of said step 28 and thus closing said switch 12, said switch 12 allows the capacitor to release in a way to supply electric current to said coil 13. In this position of said slider 6, said support 21 is arranged closely above said opening 9 in said slide 6, which allows for the axial movement of the latter. In such situation the following forces act on said support 21: force (F1) created by said movable contact 20 of said switch 16, induced force (F2) within said coil 13, wherein said forces act in the same direction, and the opposite force of said permanent magnet 15 that is close to said slider 6. As said coil 13 is located at the core 14 nearer said permanent magnet 15 that is remote from said slider, the reflection force created with the opposite magnet 15 is smaller than force (F1), and that's why said support 21 with said core 14 move towards said permanent magnet 15 at said slider 6. After a several nanoseconds the current from the capacitor discontinues and the force of said magnet 15 at said slider 6 manages to keep said core 14. Upon a command for the opening of the lock, the capacitor first creates short current and sends it to said coil 13, which now creates a stronger pole within said core 14 on the side of said magnet 15, which is remote from said slider 6. Mutual attraction of said core 14 and said magnet 15 larger than the oppositely oriented force (F1) and for this reason the support shifts to the opposite end position, wherewith said switch 16 opens and the lock unlocks. This ensures the consecutive nature of appliance door closing even within a very short time: first the mechanical lock of the door is closed and only then said switch 16 is closed, which creates a signal "door closed" to the programme selection switch.

It is understood that a man skilled in the art can design other embodiments of the lock by knowing the above description without circumventing the characteristics of the invention defined in the appended claims.

The invention claimed is:

1. A safety lock for a door of a household appliance, is composed of a housing on one end of which there is a mechanical assembly of the door lock, on an other end there is an assembly of an electric switch used to reach closed or an interrupted electric circuit, into which also a part of a programme selection switch is included, whereby the assembly of the door lock and the assembly of the electric switch are mutually linked by a slider, which is designed in a way that a lug of the slider engages with a hook of the appliance door, when the hook is in a guide, so that upon manual closing of the appliance door the hook pushes the slider towards the assembly when entering the guide, whereas a spring is foreseen to return the slider to its original position while the appliance door is opening, and on the housing there is a means used to manually switch the electric switch off in case the safety lock or electric installation gets damaged or in case of mains breakdown, wherein on a part of the slider in an area of the assembly there is an opening and an inclination and that the assembly of the electric switch is composed of a switch, of an electromagnetic coil with an axially movable core, of two permanent magnets located at a distance from the ends of the core, whereas a movable contact of the switch engages with the inclination on the slider, so that the movable contact closes the switch when the slider is shifted towards the assembly upon manual closing the appliance door, and the switch is included in the circuit for the indication of openness/closeness of the appliance door together with the programme selection switch, and the movable contact of which is positioned on the holder fixed on the core of the coil, whereas the coil is controlled by DC, the polarisation of which is determined by the programme selection switch depending on the operation of the appliance or termination of operation, and that the core is axially movable by means of the coil and fixed in one or another end positions and adjacent to the adequate permanent magnet even if current is not present in the coil.

2. The safety lock as claimed in claim 1, wherein the magnets are positioned with the same poles facing each other.

3. The safety lock as claimed in claim 1, wherein the current flowing through the switch supplies either (a) directly at least one essential user of a household appliance or (b) same, yet via a power switch.

4. The safety lock as claimed in claim 1, wherein when the circuit for the indication of door openness/closeness in the switch is closed, the part of the holder sinks into the opening in the slider.

5. The safety lock as claimed in claim 1, wherein the means acts on the holder, whereas the holder moved by the means remains in its new (second) end position due to being attracted by the opposite permanent magnet, regardless of the status of electric installations or of the electric current in the appliance or part thereof.

6. Safety lock as claimed in claim 1, wherein said coil is shifted axially along the core towards said permanent magnet, which is remote from said slider and that said movable contact of said switch is designed as a spring moved by an axially movable plug, one end of which is pivotably and at the same time axially movably arranged within said housing, and another end fitting an indentation in said slider, wherein said indentation is designed as a two-part component, one part having a step and the other part-designed as an inclination, wherein permanent magnets are mutually oriented in a way that the poles north-south or vice versa match.

7. A device comprising:

a washing machine including the safety lock of claim 1.

8. A device, comprising:

a safety lock for a door of a household appliance, including:

a housing;

a mechanical assembly of the door lock on one end of the housing;

an assembly of an electric switch used to reach closed or an interrupted electric circuit on another end of the housing, wherein at least a part of a programme selection switch is included in the device, and wherein the assembly of the electric switch includes an electromagnetic coil with an axially movable core comprising two permanent magnets located at a distance from the ends of the core;

a slider, wherein the mechanical assembly and the assembly of the electric switch are mutually linked by the slider, wherein the slider includes a lug configured to engage with a hook of the appliance door, when the hook is in a guide of the safety lock, so that upon manual closing of the appliance door the hook pushes the slider towards the assembly of the electric switch when entering the guide;

a spring positioned and configured to return the slider to its original position while the appliance door is opening;

a manual switch configured to manually switch the electric switch off, wherein on a part of the slider in an area of the assembly of the electric switch there is an opening and an inclination, the device further includes a movable switch contact configured to engage with the inclination on the slider, so that the movable contact is closed when the slider is shifted towards the assembly of the electric switch upon manual closing the appliance door, an indicator switch is included in the circuit configured to provide an indication of openness/closeness of the appliance door, and a movable contact of the indicator switch is positioned on a holder fixed on the core of the coil, the coil is controlled by DC, the polarisation of which is determined by the programme selection switch depending on at least one of the operation of the appliance or termination of operation, and the core is axially movable by means of the coil and fixed in one or another end positions and adjacent to a permanent magnet even if current is not present in the coil.

9. The device of claim 8, wherein the indicator switch is included in the circuit configured to provide an indication of openness/closeness of the appliance door together with the programme selection switch.

10. The device of claim 8, wherein the permanent magnets are positioned with the same poles facing each other.

11. The device of claim 8, wherein the current flowing through the manual switch supplies either (a) directly at least one essential user of a household appliance or (b) same, yet via a power switch.

12. The device of claim 8, wherein when the circuit for the indication of door openness/closeness in the manual switch is closed, a part of the holder sinks into the opening in the slider.

13. The device of claim 8, wherein the manual switch acts on the holder, whereas the holder moved by the manual switch remains in a second end position due to being attracted by the opposite permanent magnet, regardless of the status of electric installations or of the electric current in the appliance or part thereof.

14. The device of claim 8, wherein said coil is shifted axially along the core towards said permanent magnet, which is remote from said slider and that said a movable switch contact is designed as a spring moved by an axially movable plug, one end of which is pivotably and at the same time axially movably arranged within said housing , and another end of which fits in the indentation in said slider, wherein said indentation is designed as a two-part component, one part having a step and the other part-designed as an inclination, wherein the permanent magnets are mutually oriented in a way that the poles north-south or vice versa match.

15. A device comprising:

a washing machine including the device of claim 8.

16. A device, comprising:

a safety lock for a door of a household appliance, including:

an assembly of an electric switch, wherein the assembly of the electric switch includes an electromagnetic coil with an axially movable core comprising two permanent magnets located at a distance from the ends of the core;

a programme selection switch included in the assembly of the electric switch;

a slider, wherein the slider includes a lug configured to engage with a hook of the appliance door, when the hook is in a guide of the safety lock, so that upon manual closing of the appliance door the hook pushes the slider towards the assembly of the electric switch when entering the guide;

a movable switch contact configured to engage with a component of the slider, so that the movable contact is closed when the slider is shifted towards the assembly of the electric switch upon manual closing the appliance door;

an indicator switch configured to provide an indication of openness/closeness of the appliance door, and a movable contact of the indicator switch is positioned on a holder fixed on the core of the coil, the coil is controlled by DC, the polarisation of which is determined by the programme selection switch depending on at least one of the operation of the appliance or termination of operation, and the core is axially movable by energizement of the coil and fixed in one or another end positions and adjacent to a permanent magnet even if current is not present in the coil.

17. The device of claim 16, further comprising a manual switch configured to manually switch the electric switch off, wherein on a part of the slider in an area of the assembly of the electric switch there is an opening and an inclination, the inclination corresponding to the component of the slider.

18. The device of claim 16, wherein the indicator switch is included in a circuit configured to provide an indication of openness/closeness of the appliance door together with the programme selection switch.

19. The device of claim 16, wherein said coil is shifted axially along the core towards said permanent magnet, which is remote from said slider and that said a movable switch contact is designed as a spring moved by an axially movable plug, one end of which is pivotably and at the same time axially movably arranged within said housing , and another end of which fits in the indentation in said slider, wherein said indentation is designed as a two-part component, one part having a step and the other part-designed as an inclination, wherein the permanent magnets are mutually oriented in a way that the poles north-south or vice versa match.

20. A device comprising:

a washing machine including the device of claim 16.

* * * * *